US006360383B1

(12) United States Patent
Tseng

(10) Patent No.: US 6,360,383 B1
(45) Date of Patent: Mar. 26, 2002

(54) HAMMOCK

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/812,170

(22) Filed: Mar. 19, 2001

(51) Int. Cl.[7] ..... A45F 3/24
(52) U.S. Cl. ..... 5/129; 5/127; 5/120
(58) Field of Search ..... 5/120, 122, 127, 5/129

(56) References Cited

U.S. PATENT DOCUMENTS 2,469,950 A * 5/1949 Carl ..... 5/129
4,925,138 A * 5/1990 Rawlins ..... 5/129
4,975,994 A * 12/1990 Barmettler ..... 5/120
5,003,652 A * 4/1991 Bayless ..... 5/129
5,297,302 A * 3/1994 Anderson ..... 5/127
5,729,845 A * 3/1998 Hsu ..... 5/127

* cited by examiner

*Primary Examiner*—Michael F. Trettel
(74) *Attorney, Agent, or Firm*—Ladas & Parry

(57) ABSTRACT

A hammock frame has different parts that can be disassembled and that have small sizes to facilitate packaging and transport. The hammock frame includes front and rear legs. A bridging unit rests on and is connected detachably to the front and rear legs. Front and rear hanger rods are connected detachably to front and rear ends of the bridging unit. Each hanger rod is disposed between a pair of auxiliary support rods which have lower ends connected detachably to the bridging unit, and upper ends connected detachably to the hanger rods. A pair of flexible suspending units have upper ends connected detachably to the hanger rods and lower ends connected to a bed member for suspending the bed member swingably on the hammock frame.

9 Claims, 3 Drawing Sheets

HAMMOCK

BACKGROUND OF THE INVENTION

1. Field of the Invention

The present invention relates to a hammock, more particularly to one having different parts that can be disassembled to save packaging space and thereby reduce packaging, storage and transport costs.

2. Description of the Related Art

FIG. 1 shows a conventional hammock 1 which is shown to include a hammock frame 11 and a bedmember 12 suspended on the hammock frame 11 by means of two sets of linking chains 123. The hammock frame 11 includes a longitudinal rod 14 having a bottom section 141 to be disposed on a ground surface, and two upwardly turning sections 142 extending from the bottom section 141. A pair of foot members 13 are secured to the bottom section 141 of the longitudinal rod 14, and are transverse to the longitudinal rod 14. A pair of ring connectors 15 are provided on upper ends of the upwardly turning sections 142 for connecting with upper ends of the linking chains 123 thereat. Lower ends of the linking chains 123 are connected to front and rear edges of the bed member 12 such that the bed member 12 is swingable on the hammock frame 11.

The bed member 12 can be disassembled from the hammock frame 11 for packaging or transport purposes. However, the longitudinal rod 14 has a relatively long length and turns upwardly at its two opposite end sections. The foot members 13 are secured to the longitudinal rod 14 by welding or by rivet joint, and are transverse to the longitudinal rod 14. As such, the hammock frame 11 has a relatively large size which is inconvenient in delivery. Moreover, a large amount of packing material would be required to pack the hammock frame 11, and the packaged hammock frame 11 would occupy a relatively large amount of space. These unavoidably result in an increase in transport costs.

SUMMARY OF THE INVENTION

Therefore, the main object of the present invention is to provide a hammock with different parts that can be disassembled to result in reduced packaging, storage and transport costs.

Accordingly, the hammock of the present invention includes front and rear legs, a bridging unit, front and rear hanger rods, front and rear auxiliary support, a bed member, and a pair of suspending units. The front and rear legs are spaced-apart from each other in a longitudinal direction. Each of the legs has left and right ends adapted to be supported on a ground surface, and a raised intermediate portion extending between the left and right ends and adapted to be disposed above the ground surface. The bridging unit rests on the intermediate portions of the front and rear legs, and includes left and right bridging rods and a central bridging rod disposed between and connected to the left and right bridging rods. Each of the left and right bridging rods has front and rear end portions that are opposite to each other in the longitudinal direction and that are fastened detachably and respectively to the intermediate portions of the front and rear legs. The central bridging rod has front and rear end portions opposite to each other in the longitudinal direction. Each of the front and rear hanger rods has a lower end connected detachably to a respective one of the front and rear end portions of the central bridging rod, an upper end extending from the lower end away from the bridging unit, and an intermediate section between the lower and upper ends. Each of the front and rear auxiliary supports includes left and right support rods that have a respective one of the front and rear hanger rods disposed there between. Each of the left and right support rods of the front auxiliary support has an upper end fastened detachably to the intermediate section of the front hanger rod, and a lower end fastened detachably to the front end portion of a respective one of the left and right bridging rods. Each of the left and right support rods of the rear auxiliary support has an upper end fastened detachably to the intermediate section of the rear hanger rod, and a lower end fastened detachably to the rear end portion of a respective one of the left and right bridging rods. The bed member is disposed above the bridging unit and between said front and rear hanger rods. The bed member has front and rear end portions opposite to each other in the longitudinal direction. Each of the suspending units includes at least two flexible and elongated suspending members that have upper ends connected detachably to the intermediate section of a respective one of the front and rear hanger rods, and spaced-apart lower ends connected detachably to a respective one of the front and rear end portions of the bed member for suspending the bed member on the front and rear hanger rods.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
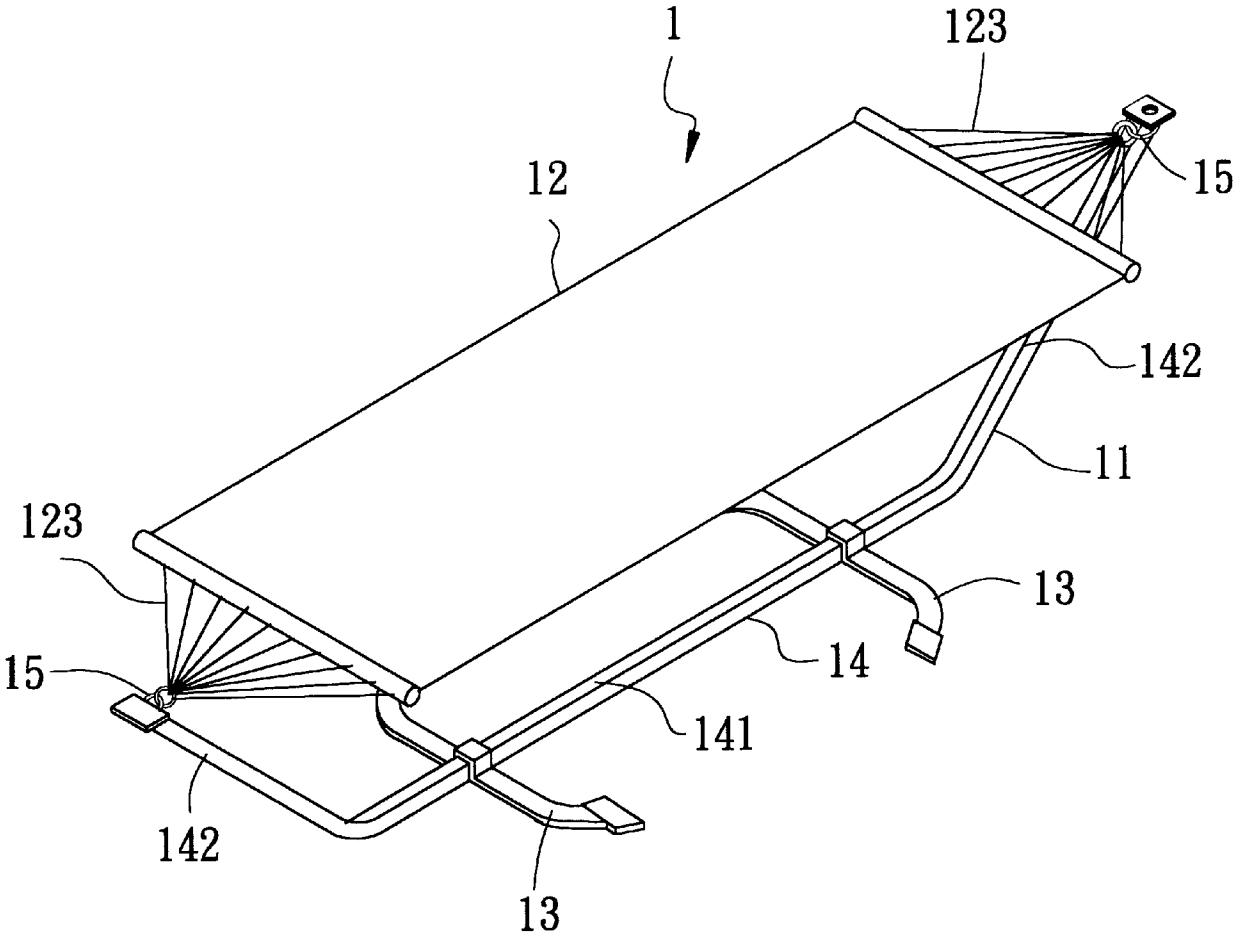
FIG. 1 is a perspective view of a conventional hammock.
Figure 2:
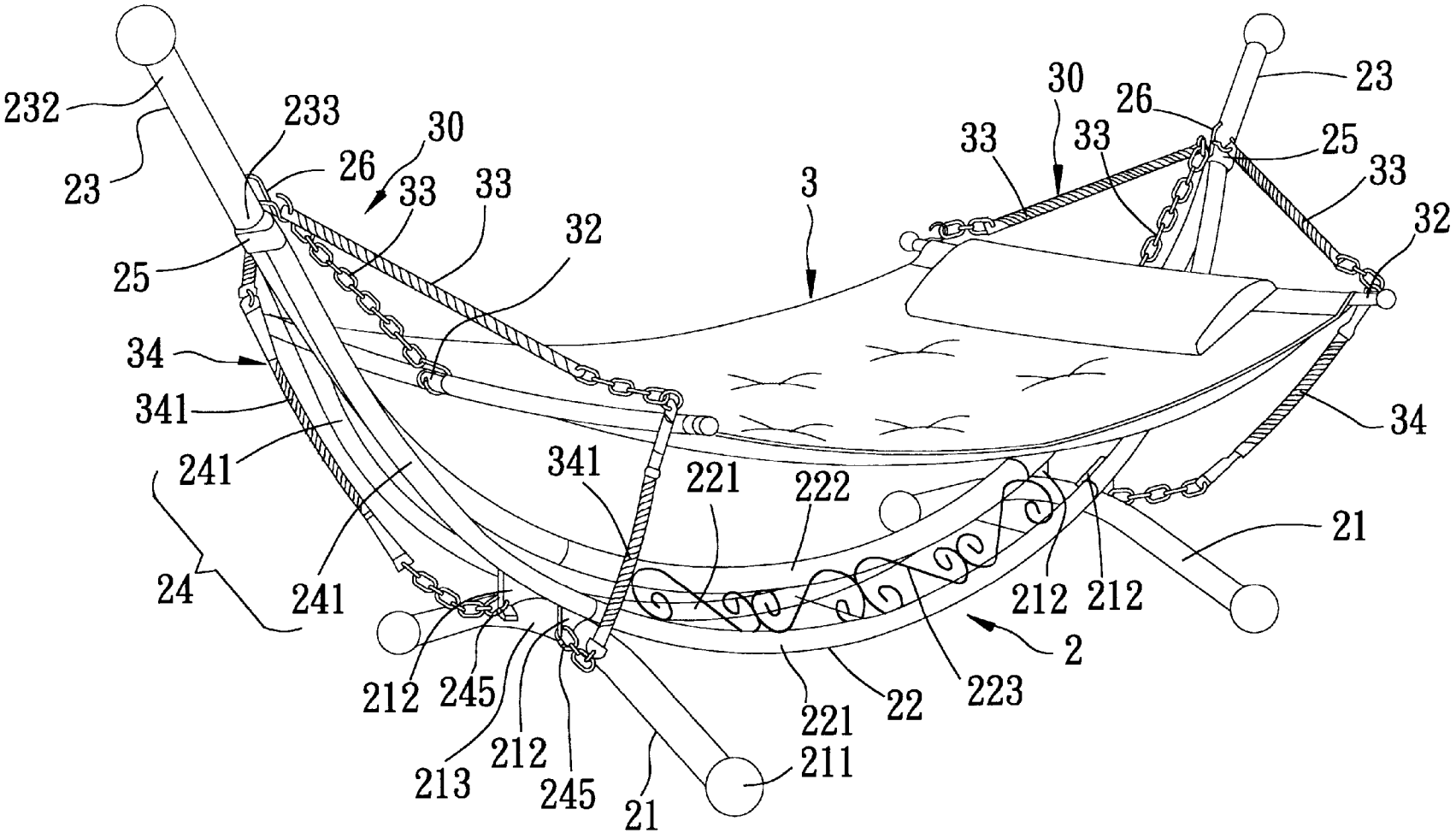
FIG. 2 is a perspective view of a preferred embodiment of a hammock of the present invention.
Figure 3:
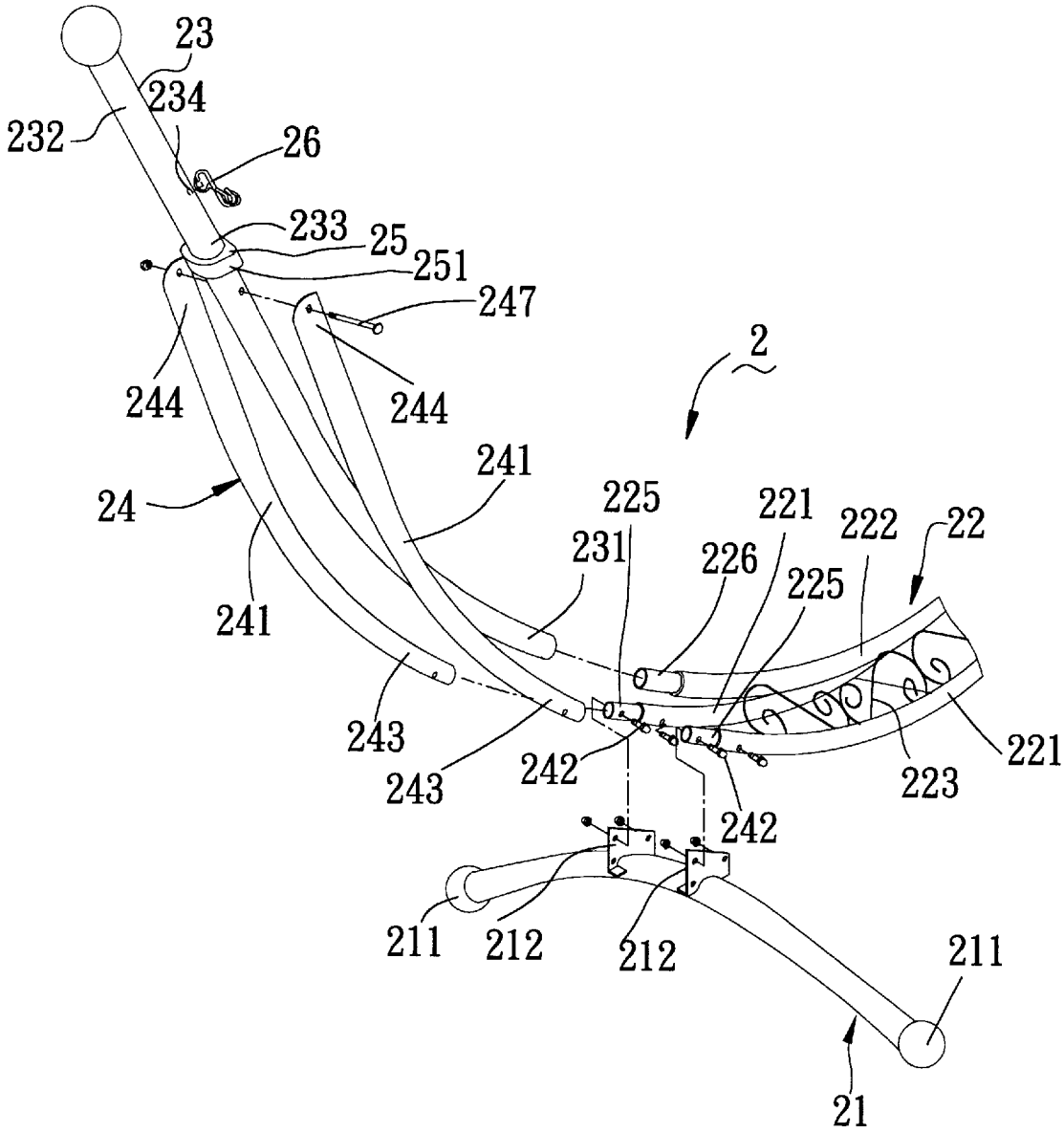
FIG. 3 is a fragmentary exploded perspective view illustrating a hammock frame of the preferred embodiment.

Referring to FIGS. 2 and 3, the preferred embodiment of the hammock of the present invention is shown to mainly include a hammock frame 2, a bed member 3, and a pair of suspending units 30 for suspending the bed member 3 on the hammock frame 2.

The hammock frame 2 includes front and rear legs 21, a bridging unit 22, front and rear hanger rods 23, and front and rear auxiliary supports 24. The front and rear legs 21 are spaced-apart in a longitudinal direction. Each of the front and rear legs 21 has a curved rod with left and right ends 211 opposite to each other in a transverse direction that is transverse to the longitudinal direction, and a raised intermediate portion 213 extending between the opposite ends 211. The left and right ends 211 of each of the front and rear legs 21 are adapted to be supported on a ground surface, while the intermediate section 213 is adapted to be disposed above the ground surface. A pair of fastening plates 212, which are spaced apart in the transverse direction, are welded to the intermediate portion 213 of each of the legs 21 and extend upwardly therefrom. The fastening plates 212 are formed with fastener holes.

The bridging unit 22 rests on the intermediate portions 213 of the front and rear legs 21, and extends across the front and rear legs 21. The bridging unit 22 includes left and right bridging rods 221 and a central bridging rod 222 which is disposed between the left and right bridging rods 221 and which is connected rigidly to the left and right bridging rods 221 by means of a plurality of curled connecting strips 223 that are welded to the left and right bridging rods 221 and the central bridging rod 222. Each of the left and right bridging rods 221 is formed as a curved rod with a circular cross-section and a convex lower periphery, and has front and rear end portions 225 which are opposite to each other in the longitudinal direction. Each of the front and rear end portions 225 of the left and right bridging rods 221 is reduced in diameter. The central bridging rod 222 is disposed at a level higher than the left and right bridging rods 221, and is also formed as a curved rod with a circular cross-section and a convex lower periphery, and has front and rear end portions 226 that are opposite to each other in the longitudinal direction. Each of the front and rear end portions 226 of the central bridging rod 222 is reduced in diameter.

Each of the front and rear hanger rods 23 is formed as a curved rod with a circular cross-section, and has a tubular lower end 231 sleeved fittingly on a respective one of the front and rear end portions 226 of the central bridging rod 222, an upper end 233 extending from the lower end 231 away from the bridging unit 22, and an intermediate section 233 between the lower and upper ends 231, 232. The intermediate section 233 is formed with a hook engaging hole 234 at one side confronting the other one of the hanger rods 23.

The front and rear auxiliary supports 24 are disposed respectively at front and rear sides of the bridging unit 22. Each of the front and rear auxiliary supports 24 includes left and right support rods 241 disposed respectively on left and right sides of a respective one of the front and rear hanger rods 23. Each of the left and right support rods 241 is formed as a curved rod with a tubular lower end 243 which is sleeved on a respective one of the front and rear end portions 225 of the left and right bridging rods 221 and which is fastened detachably to the left and right bridging rods 221 and to the fastening plates 212 by means of screw fasteners 242. The left and right support rods 241 of each of the front and rear auxiliary supports 24 further has upper ends 244 fastened detachably to the intermediate section 233 of a respective one of the front and rear hanger rods 23 by means of a screw fastener 247.

A pair of protective caps 25 are sleeved slidably on the intermediate sections 233 of the front and rear hanger rods 23. Each of the protective caps 25 has an annular flange 251 extending around the upper ends 244 of the left and right support rods 241 of a respective one of the front and rear auxiliary supports 24 for covering the screw fastener 247.

A pair of four-way hooks 26 are provided on the front and rear hanger rods 23 at the hook engaging holes 234. Each of the suspending units 30 includes three flexible suspending members 33, which are formed as ropes and chains. The suspending members 33 of each of the suspending units 30 have upper ends hooked at a respective four-way hook 26, and lower ends spaced-apart from each other and connected detachably to left and right ends and to a middle portion of a rigid strip 32 provided on a respective one of front and rear ends of the bed member 3.

A pair of stabilizing linking units 34 are provided below the pair of suspending units 30, respectively. Each of the linking units 34 includes two flexible linking members 341, each being in the form of a section of rope connected with a section of chain. The linking members 341 have upper ends connected to lower ends of left and right ones of the suspending members 33, and lower ends connected detachably to the fastening plates 212 on the front and rear legs 21 by means of a pair of ring connectors 245 which are operable to permit removal of the linking members 341 from the fastening plates 212. The linking members 341 have sufficient length to permit swinging of the bed member 3 on the hammock frame 2 and to stabilize the bed member 3 so as to prevent overturning of the bed member 3.

The hammock 2 is assembled as follows: The bridging unit 22 is first fastened to the fastening plates 212 on the legs 21 using screw fasteners 242. Then, the lower ends 231 of the front and rear hanger rods 23 are sleeved onto the front and rear end portions 226 of the central bridging rod 222, and the lower ends 243 of the left and right support rods 241 of the auxiliary supports 24 are sleeved onto the front and rear end portions 225 of the left and right bridging rods 221. The lower ends 243 of the support rods 241 are fastened to the left and right bridging rods 221 and to the fastening plates 212 using screw fasteners 224. The upper ends 244 of the support rods 241 are fastened to the front and rear hanger rods 23 using screw fasteners 247. The protective sleeves 25 are subsequently slid along the hanger rods 23 for covering the joints of the upper ends 244 of the support rods 241 and the hanger rods 23. Finally, the hooks 26 are attached to the hanger rods 23, the suspending members 33 are attached to the hooks 26, and the linking members 341 are attached to the fastening plates 212.

Since the screw fasteners 242, 245, the hooks 26, and the ring connectors 27 are detachable, the bed member 3 can be disassembled from the hammock frame 2, and the hammock frame 2 can be disassembled into different parts which are relatively small in size. Moreover, the legs 21, the hanger rods 23, the support rods 241, and the bridging rods 221, 222 of the bridging unit 22 are formed as curved rods with generally similar curvatures, and can be stacked on one another when disassembled, thereby reducing the required amount of packaging material, and thus reducing the required storage space as well as transport costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A hammock, comprising:

front and rear legs spaced-apart from each other in a longitudinal direction, each of said legs having left and right ends adapted to be supported on a ground surface, and a raised intermediate portion extending between said left and right ends and adapted to be disposed above the ground surface;

a bridging unit resting on said intermediate portions of said front and rear legs, said bridging unit including left and right bridging rods and a central bridging rod disposed between and connected to said left and right bridging rods, each of said left and right bridging rods having front and rear end portions that are opposite to each other in said longitudinal direction and that are fastened detachably and respectively to said intermediate portions of said front and rear legs, said central bridging rod having front and rear end portions opposite to each other in said longitudinal direction;

front and rear hanger rods, each of which has a lower end connected detachably to a respective one of said front and rear end portions of said central bridging rod, an upper end extending from said lower end away from said bridging unit, and an intermediate section between said lower and upper ends;

front and rear auxiliary supports, each of which includes left and right support rods that have a respective one of said front and rear hanger rods disposed therebetween, each of said left and right support rods of said front auxiliary support having an upper end fastened detachably to said intermediate section of said front hanger rod, and a lower end fastened detachably to said front end portion of a respective one of said left and right bridging rods, each of said left and right support rods of said rear auxiliary support having an upper end fastened detachably to said intermediate section of said rear hanger rod, and a lower end fastened detachably to said rear end portion of a respective one of said left and right bridging rods;

a bed member disposed above said bridging unit and between said front and rear hanger rods, said bed member having front and rear end portions opposite to each other in said longitudinal direction; and a pair of suspending units, each of which includes at least two flexible and elongated suspending members that have upper ends connected detachably to said intermediate section of a respective one of said front and rear hanger rods, and spaced-apart lower ends connected detachably to a respective one of said front and rear end portions of said bed member for suspending said bed member on said front and rear hanger rods.

2. The hammock as claimed in claim 1, further comprising a pair of linking units, each of which includes two flexible and elongated linking members that have spaced-apart upper ends connected detachably to a respective one of said front and rear end portions of said bed member, and lower ends connected detachably to said intermediate portion of a respective one of said front and rear legs.

3. The hammock as claimed in claim 1, wherein said intermediate portion of each of said front and rear legs is provided with a pair of upwardly extending fastening plates, said front and rear end portions of said left and right bridging rods being fastened detachably to said fastening plates on said front and rear legs.

4. The hammock as claimed in claim 1, wherein each of said front and rear legs, said left and right support rods of said front and rear auxiliary supports, said front and rear hanger rods, said left and right bridging rods, and said central bridging rod is curved in shape.

5. The hammock as claimed in claim 1, wherein said central bridging rod of said bridging unit is disposed at a level higher than said left and right bridging rods.

6. The hammock as claimed in claim 1, further comprising a screw fastener extending through said upper ends of said left and right support rods and said intermediate section of a respective one of said front and rear hanger rods, and a protective cap sleeved on said intermediate section of a respective one of said front and rear hanger rods, said protective cap having an annular flange disposed around said upper ends of said left and right support rods of a respective one of said front and rear auxiliary supports for covering screw fastener.

7. The hammock as claimed in claim 1, wherein each of said front and rear end portions of said left and right bridging rods has a reduced cross-section, said lower end of each of said left and right support rods of said front and rear auxiliary supports being tubular in shape and being sleeved on the respective one of said front and rear end portions of said left and right bridging rods.

8. The hammock as claimed in claim 1, wherein each of said front and rear end portions of said central bridging rod has a reduced cross-section, said lower end of each of said front and rear hanger rods being tubular in shape and being sleeved fittingly on the respective one of said front and rear end portions of said central bridging rod.

9. The hammock as claimed in claim 1, further comprising a pair of hooks for hooking said upper ends of said suspending members on said intermediate sections of said front and rear hanger rods.

* * * * *